US005575743A

United States Patent [19]

Jones et al.

[11] Patent Number: 5,575,743

[45] Date of Patent: Nov. 19, 1996

[54] METHOD AND APPARATUS FOR EXERCISING ADDUCTOR MUSCLES

[75] Inventors: Arthur A. Jones, Ocala; Philip Sencil, Anthony, both of Fla.

[73] Assignee: MedX Corporation, Ocala, Fla.

[21] Appl. No.: 397,938

[22] Filed: Mar. 3, 1995

Related U.S. Application Data

[63] Continuation-in-part of Ser. No. 194,460, Feb. 8, 1994, Pat. No. 5,421,796.

[51] Int. Cl.[6] ..... A63B 23/04

[52] U.S. Cl. ..... 482/97; 482/100; 482/136

[58] Field of Search ..... 482/97–101, 135–138, 482/907

[56] References Cited

U.S. PATENT DOCUMENTS

| | | | |
|---|---|---|---|
| 684,688 | 10/1901 | Herz | 482/97 |
| 4,125,258 | 11/1978 | McArthur | 482/100 |
| 4,349,194 | 9/1982 | Lambert, Jr. et al. | 482/100 |
| 4,478,411 | 10/1984 | Baldwin | 482/136 |
| 5,026,049 | 6/1991 | Goodman | 482/907 X |
| 5,135,452 | 8/1992 | Jones | 482/99 |
| 5,256,125 | 10/1993 | Jones | 482/137 |

*Primary Examiner*—Richard J. Apley
*Assistant Examiner*—John Mulcahy
*Attorney, Agent, or Firm*—William E. Mouzavires

[57] ABSTRACT

An adductor machine including a pair of movement arms movable about a vertical axes between an open position extending laterally from the seat and a closed position extending forwardly of the seat. The movement arms are movable to the closed position by the user engaging with the inner sides of his thighs, pads respectively located on the movement arms. Movement of the movement arms is transmitted to move a resistance in the form of one or more weights in a weight stack. Such transmission is accomplished by a linkage and cam follower arrangement operatively connected between the movement arm and a weight stack pin included in the resistance weight stack. An auxiliary actuating mechanism is provided to move the movement arms between the open and closed positions independently of engaging the pads with the legs. This actuating mechanism includes a handle engageable with the cam included in the transmission to operate the cam independently of a linkage which extends between the movement arms and the cam. Each movement arm has a pair of pads spaced from each other on opposite sides of the knee. The pads are self rotatable to conform to the contour of the user.

14 Claims, 4 Drawing Sheets

METHOD AND APPARATUS FOR EXERCISING ADDUCTOR MUSCLES

RELATED APPLICATION

This application is a continuation-in-part of our prior application, Ser. No. 08/194,460, filed Feb. 8, 1994, now U.S. Pat. No. 5,421,796, and entitled TRICEPS EXERCISE MACHINE.

OBJECTS OF THE PRESENT INVENTION

The present invention generally relates to methods and apparatus for exercising muscles in the hips and legs of the human body and more specifically in its preferred embodiment, the adductor muscles in the hips and thighs.

An object of the present invention is to provide novel and improved methods and apparatus for exercising muscles in the hips and thighs of the human body.

A further object of the present invention is to provide a novel and improved machine for exercising the adductor muscles in the hips and thighs. Included herein is a provision of such a machine which facilitates for the user, access to and exit from the machine.

A further object of the present invention is to provide a novel and improved machine for exercising the adductor muscles in the hips and thighs which machine includes leg pads that are self-adjustable to the contour of the user's legs while also avoiding excessive stress on the user's knees.

Another object of the present invention is to provide a novel and improved machine for exercising adductor muscles and which incorporates an improved transmission for transmitting forces from a movement arm to a resistance.

A still further object of the present invention is to provide an adductor machine that will achieve the above objects and yet possesses a sturdy construction suitable for home or institutional use over long periods of rugged use during which it will provide effective and efficient exercise for the adductor muscles.

SUMMARY OF PREFERRED EMBODIMENT OF THE INVENTION

In summary, a preferred embodiment of a machine in accordance with the present invention includes a seat for receiving the exerciser and a pivotable backrest at the rear of the seat which is adjustable into various positions at an angle to the seat. In the preferred embodiment, a pair of movement arms are mounted for pivotable movement about vertical axes between a first position where they extend laterally outwardly from areas on opposite sides of the seat in a normal, open or unstressed position, and a second position where they extend generally forwardly in side by side relationship in a stressed position. In conducting an exercise, the user while seated and starting with the legs in a spread-eagle position, exerts pressure against the movement arms to move them inwardly from the first position to the second position identified above. At least one pair of opposed thigh pads are secured on the movement arms respectively so that they are engaged by the inner sides of the thighs respectively and move inwardly from the first to the second position identified above. In the preferred embodiment, a second pair of pads, e.g. calf pads, are respectively provided on the movement arms to be engageable with the inner side portions of the legs below the knees.

The thigh and calf pads on each movement arm are spaced from each other so that the knees of the user do not engage the pads and avoid direct and excessive stress during an exercise. In the preferred embodiment both pads on each movement arm are mounted on a rotatable shaft which will self-adjust to the particular contour or size of the user's legs. In addition the shaft is located nearer the thigh pad than the calf pad so that greater pressure is applied between the thighs and its associated pad than the calf and its associated pad.

The movement of the movement arms from their open to close positions by the user, is opposed by a resistance preferably a weight stack. A linkage, cam and cam follower arrangement is provided between the movement arms and the weight stack to raise one or more weights when the movement arms are moved from their open to their closed positions. In the preferred embodiment, a linkage is connected between the movement arms and a cam mounted to the fixed frame of the machine for rotation by the linkage. The cam follower is mounted on a follower linkage and engages the cam and is actuated thereby to raise, through another linkage, one or more resistance weights when the movement arms are moved from the open to the closed position.

In order to facilitate access to or exit from the machine, a hand lever located within easy grasp by the user is connected to the cam so that it may drive the linkage between the cam and the movement arms to move the movement arms and adjust the position of the movement arms to allow the user to easily access and exit the machine without having to apply leg pressure on the thigh and calf pads. A counterweight is fixed to the hand lever below its pivot axis to return the hand lever to an initial raised position.

DRAWINGS

Other objects and advantages of the present invention will become apparent from the following more detailed description taken in conjunction with the drawings in which.

DETAILED DESCRIPTION

Figure 1:
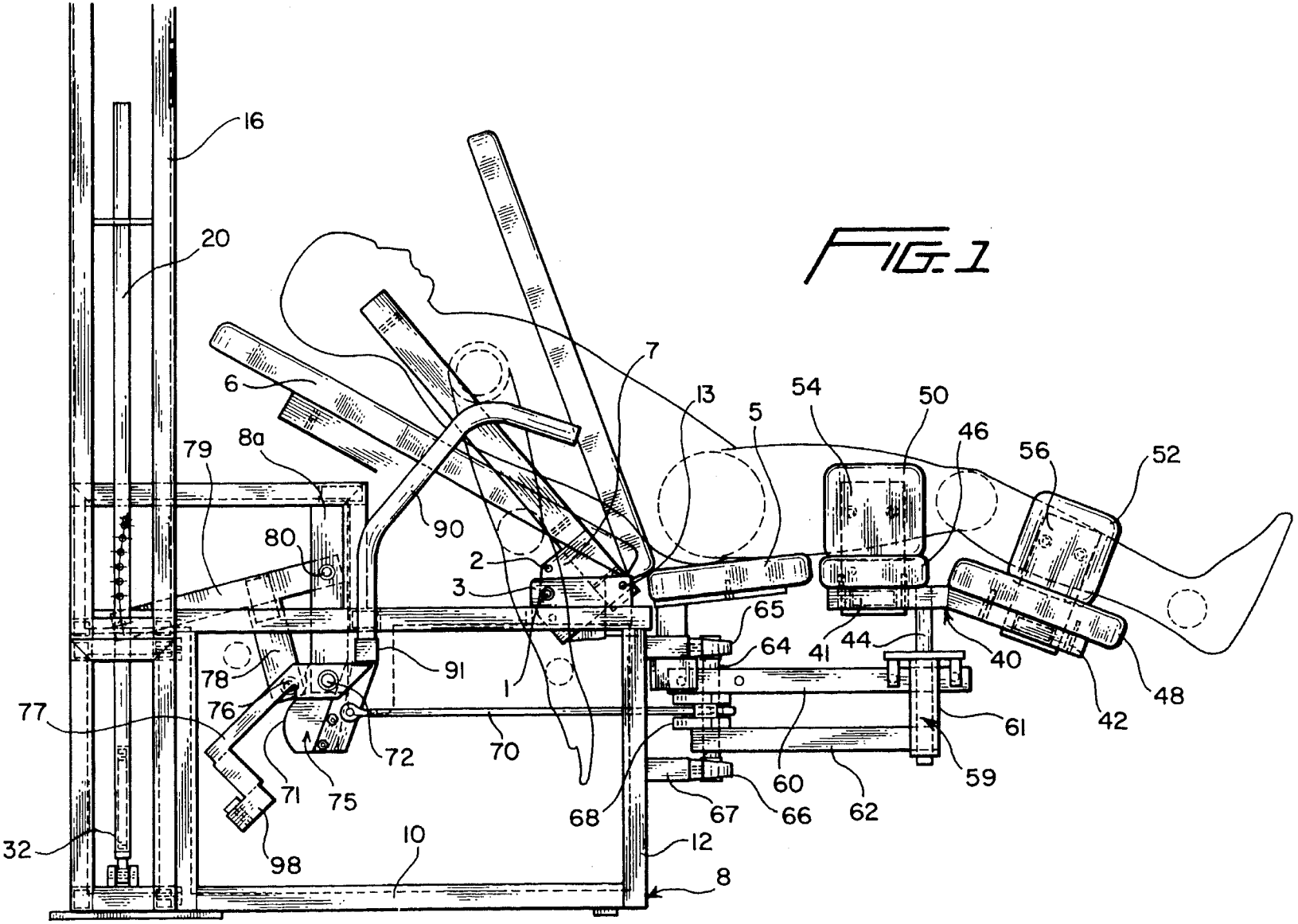
FIG. 1 is a side elevational view of an adductor exercise machine constituting one preferred embodiment of the present invention and shown with a user in position and the movement arms in a closed position.
Figure 2:
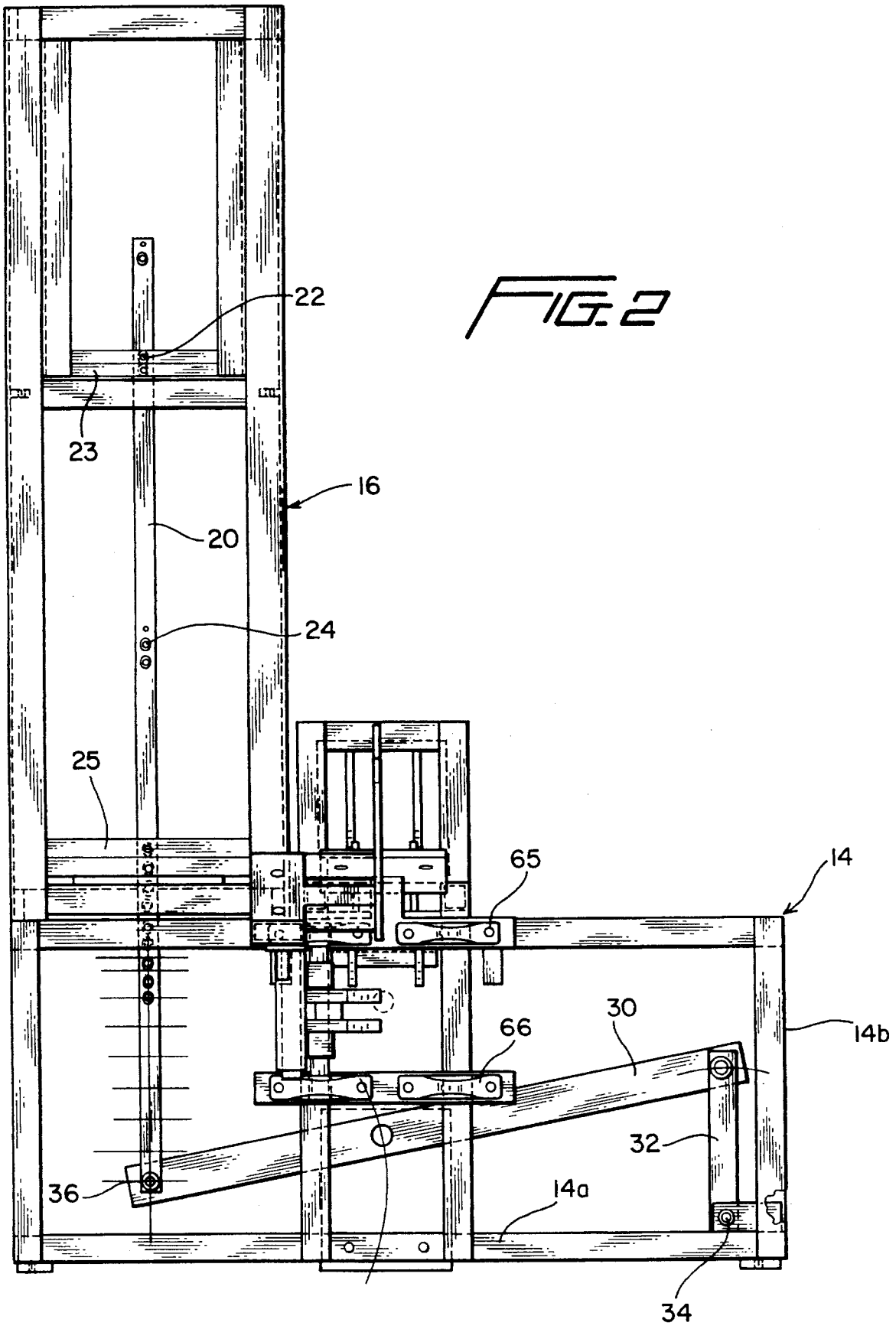
FIG. 2 is an elevational view taken from the righthand end of FIG. 1 and with the user and certain parts removed.
Figure 3:
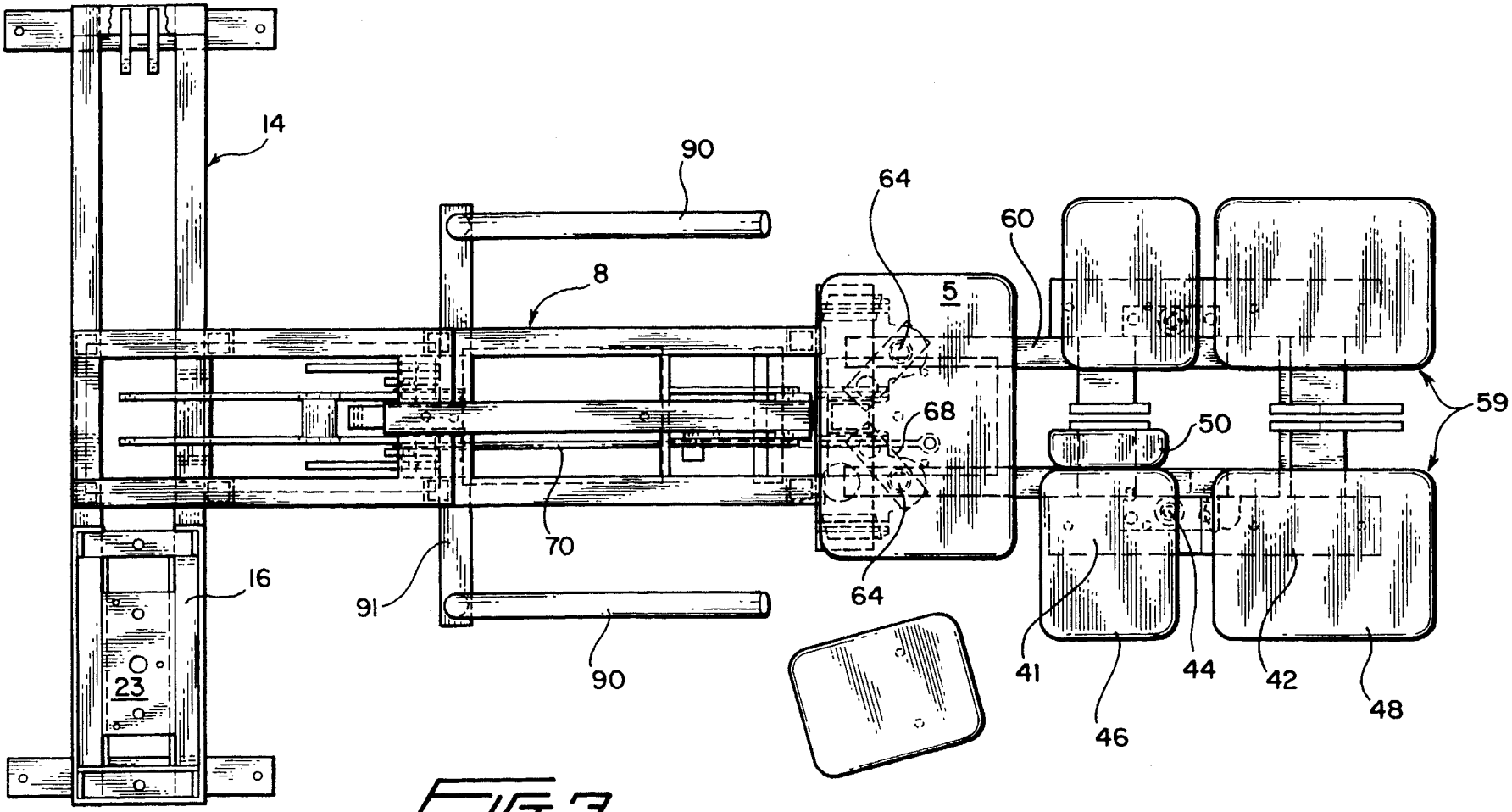
FIG. 3 is a plan view of the machine with certain parts removed.

Referring now to the drawings in detail, there is shown for illustrative purposes only an adductor exercise machine for exercising the adductor muscles of the hips and thighs. Referring to FIG. 1, the machine includes a central frame generally designated 8 including horizontal and vertical frame members 10 and 12 respectively forming a generally rectangular box-like configuration; and a rear frame generally designated 14 of rectangular construction extending transversely of the central frame 12 as shown in FIG. 3. Rear frame 14 includes horizontal portions 14*a* and vertical portions 14*b* as shown in FIG. 2. One end of rear frame 14 supports a weight stack frame 16 for housing resistance weights which in the preferred embodiment are included in a compound weight system disclosed in U.S. Pat. No. 4,834,365 issued May 30, 1989 entitled COMPOUND WEIGHT SYSTEM. The weight stack includes upper and lower stacks 23 and 25 of weights which are connectable to a vertical weight stack pin 20 by means of apertures 22 and 24. The weight stack pin 20 descends to the lower section of the rear frame 14 as best shown in FIG. 2 to be operated by an actuating lever 30 having one end pivotally connected at 36 to the weight stack pin 20 and an opposite end pivotally connected to a mounting link 32 which in turn is pivotally mounted at 34 to the rear frame 14 as best shown in FIG. 2. For a more detailed description of a compound weight stack, reference may be had to the aforementioned U.S. Pat. No. 4,834,365, whose disclosure is hereby incorporated by reference into the subject application as part hereof.

Figure 5:
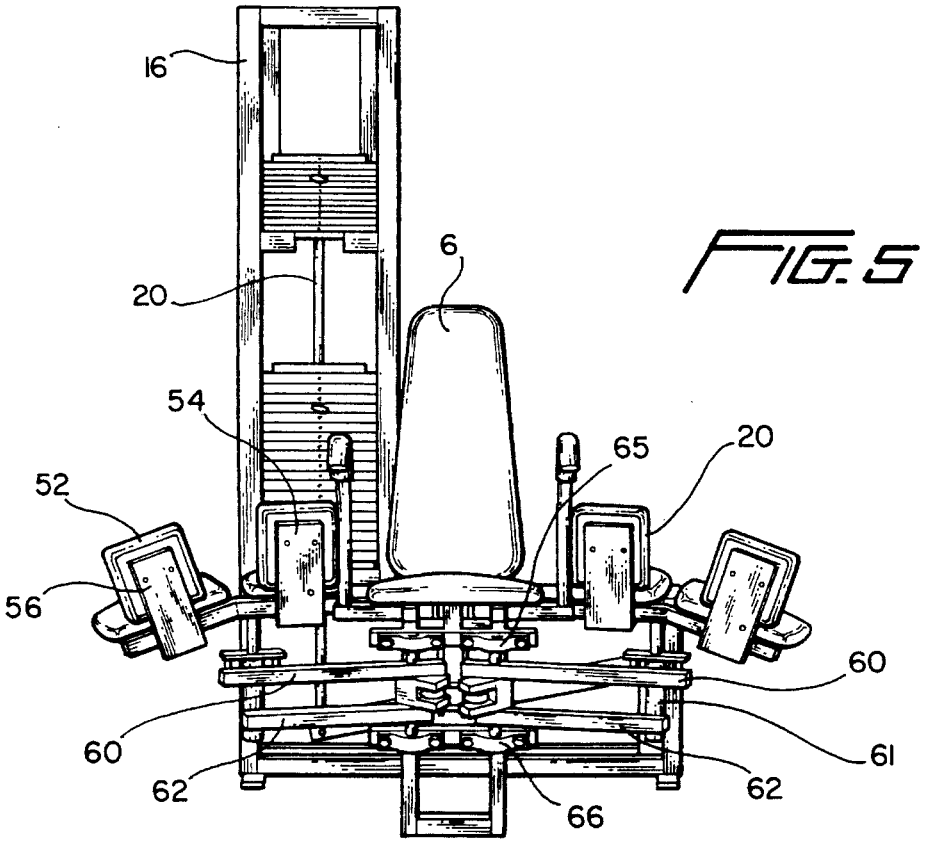
FIG. 5 is an end elevational view as seen from the front end of the machine and with the movement arms shown in open position.

Referring now to FIGS. 1, 3 and 5, the machine further includes at least one movement arm generally designated 59 in FIG. 1, however in the preferred embodiment shown two movement arms are employed to be engageable by the inner sides of the legs respectively and moved from an open or unstressed normal position shown in FIG. 5 to a stressed closed position shown in FIG. 3. In the open position shown in FIG. 5, the movement arms extend laterally outwardly from opposite side portions of seat 5. In the closed position of the movement arm shown in FIG. 3, movement arms extend forwardly from the seat in generally parallel position. In the preferred embodiment shown in the drawings, the movement arms are mounted about vertical axes shown as vertical shafts 64 mounted in bearings 65 and 66 secured to the central frame 8 as shown in FIG. 1. Mounting blocks 67 (one shown) are used to mount the bearings 65 and 66 to the vertical members 12 of the central frame 8 as best shown in FIG. 1. As shown in FIG. 3, the vertical axes are located below opposite side portions of the seat 5 and forwardly in alignment with the vertical frame members 12 of the central frame 8.

In the preferred embodiment, each movement arm includes upper and lower elongated arms 60 and 62, each mounted on shafts 64 for rotation about the axis of the shafts as will be described in greater detail. Each movement arm includes a vertical post 44 rotatably mounted in a sleeve 61 fixed across the front ends of arms 60 and 62, as best shown in FIG. 1. Secured on top of each post 44 is a pad assembly 40 including first and second pad mounting plates 41 and 42 with the latter plate fixed to plate 41 and extending forwardly but downwardly at an angle as best shown in FIG. 1. Suitable leg pads 46 and 48 are secured to plates 41 and 42. The bottom of the thighs and calves above and below the knees are engaged by pads 46 and 48 respectively as shown in FIG. 1. The movement arms are moved between the open and closed positions by the thighs which on their inner sides engage vertical pads 50 respectively located on the movement arms in opposed positions. Thigh pads 50 are fixed to the movement arms by vertical mounting plates 54 secured to horizontal mounting plates 41 in any suitable manner. An additional pair of vertical leg pads 52 are respectively secured on the movement arms at locations below the knees as best shown in FIG. 1. Vertical mounting plates 56 fixed to plates 42 are utilized to mount the pads 52. It will be seen that both pairs of leg pads 50 and 52 are located inwardly of the pads 46 and 48 in the preferred embodiment so as to be engageable by the inner side portions of the thighs and calves respectively during exercise.

Figure 4:
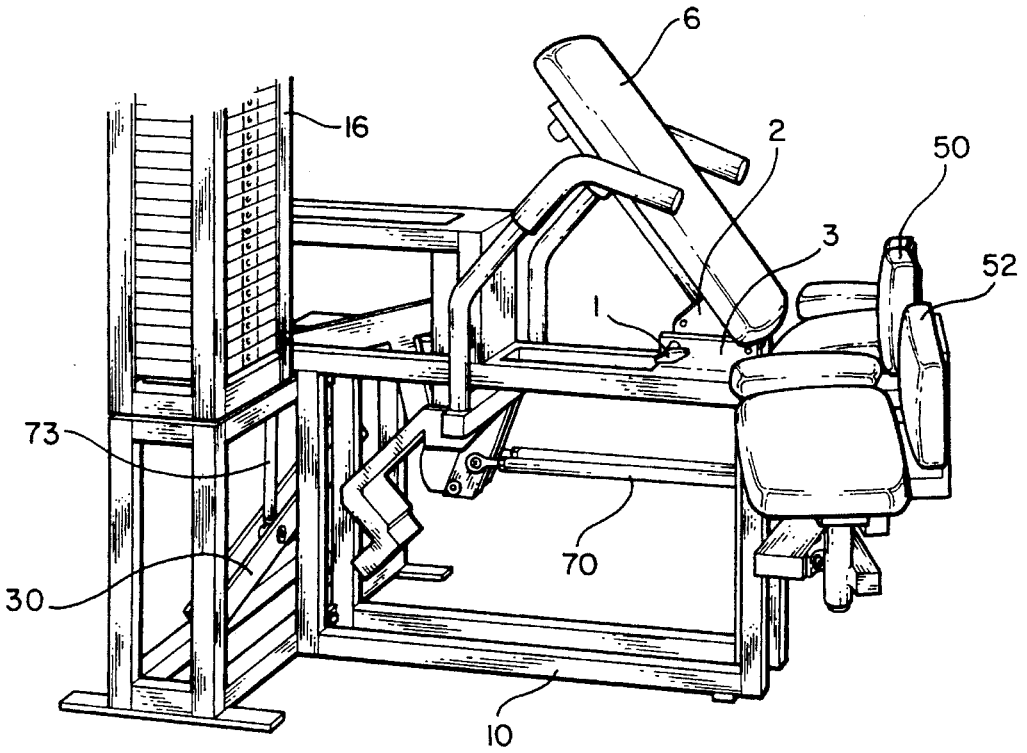
FIG. 4 is a fragmental perspective view of a rear end section of the machine as seen from one side of the machine and with the movement arms in an open position.

Rearwardly of the seat 5 is located a backrest 6 which is pivotally mounted at 13 for adjustable movement about a horizontal axis relative to the seat 5 to properly position the user's legs relative to the movement arm pads 50 and 52. Further in this regard, pads 50 and 52 are spaced from each other so that the user's knee is properly located between the pads so that pressure on the knee is avoided during exercise. Further due to the rotatable mounting of the pads 50, 52 on the shafts 44, the pads will be self-adustable to the user's leg contour and size. Moreover the mounting post 44 is located closer to thigh pad 50 than calf pad 52 so that more pressure is exerted between the thighs and thigh pads 50 than the calves and calf pads 52. Once backrest 6 is adjusted to the proper angle relative to the seat 5 to properly position the exerciser, it is secured in that position. In the preferred embodiment, one or more mounting brackets shown as vertical plates 7 are fixed to opposite sides of the backrest 6 at the lower ends thereof and provided with a series of angularly spaced apertures 2 for receiving a locking pin 1 which in turn is received on brackets 3 fixed to the upper members 10 of central frame 8 as best shown in FIGS. 1 and 4.

Forces transmitted to the movement arms through exerting the adductor muscles to move the pads and movement arms from the position shown in FIG. 5 to the position shown in FIG. 1, are transmitted to the weight stack to raise one or more weights by means of a linkage, cam and cam-follower arrangement. The latter includes in the preferred embodiment, a pair of linkage rods 70 having their forward ends pivotally mounted on short vertical pins which in turn are mounted in pairs of arms 68 fixed to the movement arm 60, 62 as best shown in FIGS. 1 and 5. The rear end of each linkage rod 70 is pivotally connected on a cam generally designated 75 as best shown in FIGS. 1 and 4. Cam 75 is mounted for rotation about a generally horizontal axis provided by a pivot pin 72 mounted in a suitable manner in the central frame 8 at the upper end thereof. When the movement arms are moved from the open position shown in FIG. 5 to the closed position shown in FIG. 1, linkage rods 70 will be moved rearwardly of the machine to push the cam 75 and rotate it clockwise about pin 72 as viewed in FIG. 1. This will cause a cam follower 76 mounted on the cam surface 71 of cam 75 to be lifted which in turn will lift a vertically extending drive rod 73 shown in FIG. 4 which in turn will pivot the actuating lever 30 upwardly to raise the weight stack pin 20 and the weights attached thereto. Cam follower 76 is mounted on a cam follower lever including a leg 78 which holds the follower 76 and a mounting arm 79 pivotally mounted by pivot 80 to an upper portion of the central support frame 8*a* as best shown in FIG. 1. Leg 78 is located intermediate the ends of the arm 79 and with the rear end of the arm 79 being pivotally mounted to the upper end of the drive member 73 as described.

In accordance with another feature of the present invention, an auxiliary actuating mechanism is provided for moving the movement arms between the open and closed position independently of exerting pressure on the pads 50 and 52. This enables the user to adjust the positions of the pads 50 and 52 to facilitate access to and exit from the machine. It also enables the user to adjust the pads 50 and 52 into the desired starting position at the beginning of an exercise to suit the dimensions of the size of the user. In the preferred embodiment shown, this mechanism includes an actuating handle or lever 90 extending vertically and forwardly of the machine at the side of the user adjacent the user's arms within convenient grasp. The lower end of the handle 90 is fixed to a cross rod shown as a horizontal structural tube 91 which is pivoted to the frame so as to engage the top of the cam and rotate it clockwise as viewed in FIG. 1. In the preferred embodiment, a pair of actuating handles 90 fixed to opposite ends of cross rod 91, are provided on opposite sides of the machine. It will be seen that clockwise rotation of the handle 90 will pivot cam 75 clockwise as viewed in FIG. 1 about pivot 72 to move the movement arms 60, 62 towards the closed position shown in FIG. 1. Upon release of the handle 90 the weight stack will return the movement arms to the open position shown in FIG. 5. In order to return the handle 90 to the raised position, a counterweight 98 is fixed to the handle below the pivot axis thereof by means of an arm 77.

In use of the machine, the user when seated may operate the handles 90 to place the pads 50, 52 in the desired position for the user, the user may then straddle the pads 50 and 52 with the inner sides of the thighs and calves engaging the pads 50 and 52 after which he may move his legs from the spreadeagle position to a closed position against the pads 50 and 52 and the resistance offered by the weight stack. Upon release of pressure on the pads 50, 52 the movement arm will return to the open position shown in FIG. 5. The exercise is repeated as desired during which excessive pressure on the knees is avoided while pressure from the thighs is properly distributed to the leg pads. Moreover the pads are self-adjustable to the size and contour of the legs. When the user wishes to exit the machine the handles are grasped and the pads 50 and 52 are moved towards their closed position to enable the user to easily dismount from the machine. It will also be seen that the motion transmission of the present invention is efficient and compact and avoids overhead cables and pulleys commonly employed with weight stacks.

Although a specific embodiment of the invention has been disclosed in the drawings and described in the specification, it will be understood that the present invention is not to be limited to the specific embodiment but rather the scope of the invention is defined in the appended claims.

What is claimed is:

1. An adductor exercise machine including a seat for receiving an exerciser, at least one movement arm mounted for movement about a generally vertical axis between an open position which extends generally laterally from the seat and a closed position which extends generally forwardly of the seat, a resistance means for opposing movement of the movement arm between the open and closed position, transmission means interconnecting the movement arm and the resistance means for moving the resistance means when the movement arm is moved from the open towards the closed position, said transmission means including a cam mounted for movement about a generally horizontal axis, linkage means interconnecting the movement arm and the cam for rotating the cam about said generally horizontal axis, a cam follower engaged on the cam and means interconnecting the cam follower and the resistance means for moving the resistance means upon rotation of the cam, and an auxiliary actuating means for rotating said cam and moving the movement arm between closed and open positions independently of engagement of the movement arm by the exerciser.

2. The machine defined in claim 1 wherein the transmission means includes a cam follower lever mounted for movement about a generally horizontal axis, said cam follower being mounted on the lever, and a generally vertically extending drive member connected between the cam follower lever and the resistance means.

3. The machine defined in claim 2 wherein said resistance means is a weight stack including a generally vertically extending weight stack pin, and wherein said transmission means further includes an actuating lever pivotally connected to the weight stack pin and wherein said drive member is pivotally connected to the actuating lever.

4. The machine defined in claim 1 wherein the auxiliary actuating means includes a lever engageable with the cam to rotate the cam about the said generally horizontal axis of movement of the cam.

5. The machine defined in claim 4 including a weight fixed to the lever below a pivot axis of the lever to bias the lever to a raised position.

6. The machine defined in claim 1 including a backrest pivotally mounted to the seat for movement into a number of adjusted positions, and locking means for holding the backrest in any of the adjusted positions.

7. The machine defined in claim 1 wherein the movement arm includes a generally vertically extending thigh pad engageable with an inner side of the thighs for moving the movement arm between said positions thereof, said thigh pad being located to engage the thigh above the knees, said movement arm including a calf pad to be engaged by an inner side of the calf below the knee, said pads being spaced from each other so that the knee may be free of any engagement with said pads.

8. The machine defined in claim 7 including means mounting said pads for rotatable movement to adjust to the position of the user's legs.

9. The machine defined in claim 7 including means mounting said pads for rotatable movement to adjust to the position of the user's legs.

10. The machine defined in claim 9 wherein said means mounting said pads for rotatable movement includes a mounting member connected to the pads and mounted for movement about a generally vertical axis.

11. The machine defined in claim 10 wherein said vertical axis of movement of said mounting member is located closer to said thigh pad than said calf pad.

12. An adductor machine including a seat for receiving an exerciser, at least one movement arm mounted for movement about a generally vertical axis between an open position which extends generally laterally from the seat and a closed position which extends generally forwardly of the seat, a resistance means for opposing movement of the movement arm between the open and closed position, transmission means interconnecting the movement arm and the resistance means for moving the resistance means when the movement arm is moved from the open towards the closed position, and an auxiliary actuating means engageable with said transmission means for moving the movement arm between closed and open positions independently of engagement of the movement arm by the exerciser, said auxiliary actuating means including a lever mounted for pivotal movement about a generally horizontal axis, and a counterweight fixed to the lever and extending below said generally horizontal axis to bias the lever to a raised position.

13. The machine defined in claim 12 wherein said transmission means includes a rotatable cam, means interconnecting the movement arm and the cam for rotating the cam, a cam follower engaged on the cam and means interconnecting the cam follower and the resistance means for moving the resistance means upon rotation of the cam, and wherein said lever is engageable with the cam to rotate the cam.

14. An adductor exercise machine including a seat for receiving an exerciser, at least one movement arm mounted for movement about a generally vertical axis between an open position which extends generally laterally from the seat and a closed position which extends generally forwardly of the seat, a resistance means for opposing movement of the movement arm between the open and closed position, transmission means including a rotatable cam interconnecting the movement arm and the resistance means for moving the resistance means when the movement arm is moved from the open towards the closed position, and an auxiliary actuating means for rotating the cam for moving the movement arm between closed and open positions independently of engagement of the movement arm by the exerciser.

* * * * *